US010687577B2

(12) United States Patent
Cadens Ballarin et al.

(10) Patent No.: US 10,687,577 B2
(45) Date of Patent: Jun. 23, 2020

(54) PROTECTIVE LINING THAT CAN BE COUPLED TO THE INNER SURFACE OF A HELMET, HELMET COMPRISING SAID LINING AND USE THEREOF IN ORDER TO REDUCE ROTATIONAL ACCELERATION TRANSMITTED TO A USER

(71) Applicant: MAT GLOBAL SOLUTIONS, S.L., Terrassa (ES)

(72) Inventors: Javier Cadens Ballarin, Sant Boi De Llobregat (ES); Marie-Christine Eckloo, Vilassar De Mar (ES); Colin Ramsay Bell, Barcelona (ES); Xavier Mateu Codina, Matadepera (ES); Pau Llibre Roig, Barcelona (ES)

(73) Assignee: MAT PRODUCT & TECHNOLOGY, S.L.U., Terrassa (ES)

( * ) Notice: Subject to any disclaimer, the term of this patent is extended or adjusted under 35 U.S.C. 154(b) by 226 days.

(21) Appl. No.: 15/549,766

(22) PCT Filed: Feb. 9, 2016

(86) PCT No.: PCT/ES2016/070074
§ 371 (c)(1),
(2) Date: Aug. 9, 2017

(87) PCT Pub. No.: WO2016/128601
PCT Pub. Date: Aug. 18, 2016

(65) Prior Publication Data

US 2018/0027915 A1 Feb. 1, 2018

(30) Foreign Application Priority Data

Feb. 9, 2015 (ES) ..... 201530152

(51) Int. Cl.
*A42B 3/12* (2006.01)
*A63B 71/08* (2006.01)

(52) U.S. Cl.
CPC ..... *A42B 3/122* (2013.01); *A63B 71/081* (2013.01); *A63B 2225/62* (2013.01)

(58) Field of Classification Search
CPC ..... A42B 3/122; A42B 3/125; A42B 3/128; A42B 3/121; A63B 71/081; A63B 2225/62

(Continued)

(56) References Cited

U.S. PATENT DOCUMENTS 3,668,704 A 6/1972 Conroy et al.
3,761,959 A 10/1973 Dunning (Continued)

FOREIGN PATENT DOCUMENTS

AU 2012101894 A4 10/2013
WO 98/23863 A1 6/1998
WO 2012/148582 A2 11/2012

OTHER PUBLICATIONS

International Search Report for PCT/ES2016/070074 dated Jun. 3, 2016 [PCT/ISA/210].
Spanish Search Report for 201530152 dated Feb. 25, 2016.

*Primary Examiner* — Alissa L Hoey
(74) *Attorney, Agent, or Firm* — Sughrue Mion, PLLC

(57) ABSTRACT

A protective liner, attachable to the inner surface of a helmet, comprising an inner face and an outer face oriented towards the inner surface of the helmet, wherein the joining of faces gives rise to a plurality of inflatable chambers permeable to water vapour and connected by means of pressurised air distribution channels. The chambers and channels form a single body extending at least along the inner surface of the helmet above the Frankfurt plane. The outer face comprises a layer of rigid material while the inner face comprises a (Continued)

layer of elastic material, whose area expands when the chambers are filled with air, such that the expansion in volume occurs mainly by means of the deformation of the elastic layer.

10 Claims, 1 Drawing Sheet

(58) Field of Classification Search
USPC ..... 2/413
See application file for complete search history.

(56) References Cited

U.S. PATENT DOCUMENTS 4,354,284 A * 10/1982 Gooding ..... A42B 3/00 2/413
4,370,754 A * 2/1983 Donzis ..... A41D 13/0153 2/16
4,566,137 A 1/1986 Gooding
5,083,320 A * 1/1992 Halstead ..... A42B 3/122 2/413
5,913,412 A * 6/1999 Huber ..... A42B 3/28 2/413
6,073,271 A * 6/2000 Alexander ..... A42B 3/122 2/413
6,178,560 B1 * 1/2001 Halstead ..... A42B 3/122 2/413
6,226,801 B1 5/2001 Alexander et al.
7,299,505 B2 * 11/2007 Dennis ..... A42B 3/12 2/410
8,544,117 B2 * 10/2013 Erb ..... A42B 3/122 2/410
2002/0166157 A1 * 11/2002 Pope ..... A42B 3/122 2/413
2003/0070209 A1 * 4/2003 Falone ..... A41D 13/015 2/412
2004/0146717 A1 * 7/2004 Corzani ..... A41D 19/0058 428/422.8
2011/0271427 A1 11/2011 Milsom
2013/0333100 A1 12/2013 Erb et al.
2014/0020158 A1 1/2014 Parsons et al.
2014/0033402 A1 * 2/2014 Donnadieu ..... A42B 3/122 2/413
2014/0259312 A1 * 9/2014 Moore ..... A42B 3/12 2/413
2014/0259313 A1 * 9/2014 Sullivan ..... A42B 3/121 2/413
2016/0037833 A1 * 2/2016 Kriesel ..... A42B 3/285 2/414
2016/0345652 A1 * 12/2016 Harty ..... A61B 5/01
2018/0237662 A1 * 8/2018 Widenbrant ..... B32B 27/065

* cited by examiner

PROTECTIVE LINING THAT CAN BE COUPLED TO THE INNER SURFACE OF A HELMET, HELMET COMPRISING SAID LINING AND USE THEREOF IN ORDER TO REDUCE ROTATIONAL ACCELERATION TRANSMITTED TO A USER

CROSS REFERENCE TO RELATED APPLICATIONS

This application is a National Stage of International Application No. PCT/ES2016/070074, filed on Feb. 9, 2016, which claims priority from Spanish Patent Application No. P 201530152, filed on Feb. 9, 2015, the contents of all of which are incorporated herein by reference in their entirety.

TECHNICAL SECTOR OF THE INVENTION

The present invention relates to a protective liner attachable to the inner surface of a helmet, which comprises an inner face, destined for coming into contact with a user's head, and an outer face oriented towards the inner surface of the helmet. The joining of the inner face and the outer face forms a plurality of inflatable chambers interconnected by channels through which air is supplied, for example, by a pump through various valves.

The invention also relates to a helmet, for example a motorcycle helmet, a sports helmet (ski, snowboard, etc.) or a professional helmet (individual protection equipment), which comprises said protective liner.

BACKGROUND OF THE INVENTION

It is well known that a helmet normally consists of a shell, which is the rigid external structure that can be seen from the outside, and is responsible for providing rigidity to the helmet and absorbing the first impact in case of a fall or collision and abrasion with the contact surface. Shells can be manufactured using thermoplastic materials (in helmets with a simpler design) and fibre-reinforced composite materials such as, for example, fibreglass, carbon fibre and Kevlar®, etc., to better absorb blows and also achieve a good resistance-lightness ratio.

The interior of the helmet, disposed on the inner surface of the shell, is a very important part as it is responsible for absorbing the impact in case of accident, due to which it must adapt to the helmet user's head in the best possible way. To this end, a filling made from impact-absorbing material is usually disposed between the shell and the internal liner of the helmet, such as pads or polystyrene foam elements. The configuration of the internal elements must adapt to the mould of the impact-absorbing material and to the anatomy of the zone of the head where they are disposed, and may have different densities according to the zone.

Lastly, all the helmets have an internal liner which, depending on the model, may be detachable in order to be washed independently from the helmet. The liner material is usually breathable in order to evacuate the sweat generated in the interior of the helmet. Mention should also be made of the cheek pads, which in some helmets are also detachable and may come in different sizes and thicknesses in order to adapt to the users.

Furthermore, it is also known that not everyone has the same head size and that there are several head types that can be classified, by shape, into round, flat (or globe), oval (taller-than-wide), egg or inverted egg. In fact, it has also been observed that persons of the same race have certain features in common as regards their head shape depending on the ethnographic group to which they belong. Thus, for example, it has been observed that Caucasian users tend to have different head shapes than Asian users. Nonetheless, there are differences in size (sizes XL, L, M, S, XS) and shape even within the same ethnographic group.

Despite the fact that this variation in terms of head size and shape is known, helmet brand manufacturers do not always offer shells adapted to each user but rather, for example, in the best of cases, manufacture models grouped by country; for example, a single helmet for Europe, Australia and South America, another helmet for the United States, Mexico and Canada, and a third helmet for Asia. Within said geographic areas, some manufacturers offer different-sized shells (XL, L, M, S, XS), with the ensuing cost, while others, in an attempt to palliate the lack of helmet sizes or shapes, manufacture either two or more different-sized shells or a single shell but combined with two or more types of internal foam elements. Also, in general, each brand manufacturer has its own shell mould style and if the user has a head shape that does not match the mould, he or she will have to choose a different brand or accept a less than perfect ergonomic fit.

In addition to the foregoing, it should also be taken into account that, in winter, motorcyclists usually place their helmet over a balaclava, as opposed to summer, due to which the user may be uncomfortable in winter if he or she bought a helmet that fits tightly over his or her bare head. The opposite case would also be unfavourable, because if he or she bought the helmet trying it on over a balaclava, in summer the helmet will not fit tightly.

Therefore, this highlights the problem arising from the lack of adaptation of helmets to user head sizes and morphologies, causing discomfort to the user as a result of the lack of ergonomic fit and thereby negatively affecting active safety.

Recently, protective liners have been developed that are intended to be placed in the interior of the helmet, formed by one or more cells or chambers that may be inflated by pressurised air, interconnected or not by means of channels. These protective liners are inflated by the user by actuating a small inflating pump provided in the helmet, for example by pressing a button, and the level of inflation can be regulated by a valve also provided in the helmet. Protective liners have a shape adapted to cover one or more zones of the head and their level of inflation will cause the space between the helmet and the user's head to be occupied by the inflated liner. Protective liners such as those described were previously developed by the applicant and/or inventors themselves, being one of the products currently manufactured and marketed. Other examples are those described in patent documents FR2888728-A1, FR2918849-A1, U.S. Pat. No. 6,817,039-B1 and U.S. Pat. No. 8,544,117-B2.

Inflatable liners should enable helmet brand manufacturers to offer less product references in terms of sizes, saving on manufacturing and distribution costs and, at the same time, provide any user, regardless of the shape of his or her head, with optimum comfort and safety using any helmet.

Despite the improvement represented by some of these liners, it should be taken into account that the user should not only be protected but also comfortable with the inflatable liner. In addition, some liners, on becoming inflated, do not achieve optimum inflation and their original shape is distorted under operational conditions of use, thus losing efficiency.

At the same time, these liners should also facilitate the perspiration of the helmet user's head and be considerably more durable than conventional foam liners, which become deformed over time, losing volume and leaving a much larger empty space in the interior of the helmet, as though it were a size larger than the original.

In addition to the user's comfort and the reduction in the number of manufacturer references, another aspect to be improved in current helmets is the level of passive safety.

In fact, it is well known that the basic function traditionally assigned to a helmet is the limitation of maximum surface pressure generated by an impact on the skull by means of the distribution of radial forces through the shell over a larger area and the absorption of energy of said impact through the controlled deformation of the shell and of the impact-absorbing material, all in a radial direction. "Radial direction" of impact is understood to be all those impacts which, initiating from the exterior of the helmet, are concurrent in the middle of the head. In current practice, all certification standards and test methodologies applied use said radial impact typology.

In the last two decades, in the field of biomechanical research in the area of accidentology, it has become evident that:

a) In a large number of accidents (motorcycle, but also bicycle, ski, horseback riding and in most sports in which helmets are normally used), the direction of impact of the helmet is not purely perpendicular with respect to the contact surface (which would generate purely radial impacts such as those described previously and applied in most standards), but rather said impacts are basically oblique (the direction of impact with respect to the surface occurs at an angle $\alpha$ where $90° > \alpha > 0°$ and, preferably, $60° > \alpha > 15°$), therefore involving contact forces with both a radial and tangential component.

b) It has been observed that said contact force with a tangential component is particularly relevant in the generation of all the most common modes and types of head accident injuries. Therefore, said tangential force component, scaled up by the inertia of the head, generates rotational accelerations in the head of very brief pulse and duration but with a high level of intensity. When the brain tissue, but also the brain/cerebrospinal fluid/cranium as a whole, is subjected to said field of accelerations, distribution of stress and tension is generated (predominantly of the shearing type, as understood in mechanical engineering) which can cause most of the injuries commonly described in scientific literature on cranial accidents if certain limits are exceeded.

c) Therefore, it is currently more accepted by the scientific community that both radial and tangential components in the direction of impact are present in nearly all accidents and that both contribute to the probability and severity of the hypothetical injury as a consequence of the linear and rotational accelerations generated respectively. Furthermore, it is recognised that, while current helmets significantly attenuate linear accelerations, their contribution to the reduction of rotational accelerations is minimal, if not non-existent.

In reference to the research carried out in the field of biomechanics in the area of accidentology, the papers published by Dr. Peter Halldin are cited herein (http://www.researchgate.net/profile/Peter_Halldin/publications).

To date, these advances in accident research have generated different product solutions or implementations aimed at limiting said rotational accelerations. Examples of these solutions are those described in patent documents U.S. Pat. No. 8,578,520-B2, EP2523572-A1, EP2114180-B1 and EP1404189-B1.

U.S. Pat. No. 8,578,520-B2 discloses a helmet comprising an energy-absorbing layer and an attachment device for securing the helmet to a user's head, wherein a sliding facilitator is provided inside the energy-absorbing layer, said facilitator being fixed to the attachment device and/or to the interior of the energy-absorbing layer and the attachment device to provide sliding between the energy-absorbing layer and the attachment device. The helmet also comprises a casing or shell disposed outside of the energy-absorbing layer. The sliding facilitator is a low-friction material connected to or integrated with the attachment device on the surface oriented towards the energy-absorbing layer and/or disposed on or integrated in the inner surface of the energy-absorbing layer oriented towards the attachment device.

Patent application EP2523572-A1 discloses an intermediate layer of a friction-decreasing material disposed between two layers. This intermediate layer is adapted to create a sliding movement between two layers when a force is applied and a tangential force component shears the layers. The friction-decreasing material comprises fibres, all or some of which may be natural fibres and/or polymer fibres.

Patent EP2114180-B1 makes reference to a locking device for fixing the position of an outer layer with respect to an inner layer in a protective helmet, wherein the protective helmet has a sliding layer disposed between the outer layer and the inner layer to facilitate the movement of the outer layer with respect to the inner layer during an oblique impact towards the protective helmet. The locking device comprises a guiding member of the layer, which has an upper portion intended to be disposed at an opening of the outer layer and a resilient lower portion extending from the upper portion and which, at its free end, is disposed in connection to the inner layer.

Patent EP1404189-B1 discloses a protective headgear comprising a shell having an inwardly facing surface which in use faces the head of a user and an outwardly facing surface which in use faces away from the head of a user. An outer layer overlies a portion of the outwardly facing surface of the outwardly facing shell and rupturing means are provided for fixedly attaching the outer layer to the remainder of the headgear at one or more locations. The rupturing means are configured so as to fail when a force greater than a selected threshold is received on an outer surface of the headgear which acts in at least part tangential direction to rotate the headgear and the head of the user. Upon failure of the rupturing means at the one or more locations, the received force causes at least part of the outer layer receiving the force to move relative to the shell in a manner which is similar to the protective movement of the human scalp relative to the skull.

Despite the enhancements achieved in the aforementioned helmets, the need to provide an alternative capable of minimising or reducing the rotational acceleration suffered by a user's head in case of accident, thereby reducing the risk and severity of the injuries that does not imply adding or considerably modifying the helmet's components, is evident.

DESCRIPTION OF THE INVENTION

With the object of providing a solution to the drawbacks raised, the invention discloses a protective liner attachable to the inner surface of a helmet that comprises an inner face, intended to come into contact with a user's head, and an outer face oriented towards the inner surface of the helmet, the joining of said faces forming a plurality of inflatable chambers that are interconnected by means of channels through which air is distributed.

In essence, the protective liner is characterised in that the plurality of chambers and channels form a single body extending along the inner surface of the helmet at least above the Frankfurt plane or tragus-orbitale horizontal line, wherein the chambers are permeable to water vapour and wherein the outer face comprises a layer of rigid material, while the inner face comprises a layer of elastic material whose area expands when the chambers are filled with air, such that the expansion in volume occurs mainly by means of the deformation of the elastic layer.

Therefore, by means of the combination of these materials, maximum efficiency of the liner is achieved, favouring a unidirectional inflation in the radial direction (with respect to the middle of the head), avoiding the lateral shrinking of the chambers when they inflate and thereby maintaining perfect cohesion between the outer face of the liner and the interior of the helmet. Additionally, since the plurality of chambers and channels are formed by a single body, it is easier to mount in the interior of the helmet.

According to a characteristic of the invention, the outer face and the inner face comprise respective layers of hydrophilic thermoplastic polyurethane welded together in the sections that form the contours of the chambers and channels. In this manner, the sensorial comfort of the user of the protective liner is not reduced by using the protective liner in his or her helmet, since it is breathable as a result of the regulating membrane system which is activated by the diffusion of the vapour pressure between the inner and outer faces of the hydrophilic thermoplastic polyurethane membranes.

In accordance with a characteristic of the invention, the layer of rigid material and the layer of elastic material are colaminated respectively with the hydrophilic thermoplastic polyurethane layer comprised by the outer face and with the hydrophilic thermoplastic polyurethane layer comprised by the inner face.

According to a preferred embodiment of the invention, the layer of rigid material is a polyamide fabric having a linear weight comprised between 70 and 300 dtex.

Also according to the preferred embodiment, the layer of elastic material of the inner face has a linear elongation comprised between 20% and 150% with respect to its unloaded initial length, and an elastic return greater than 95%.

The layer of elastic material of the inner face may be a mesh-type stretch fabric or a woven elastane-based fabric. By way of clarification, the mesh-type fabric is also known as "knitted fabric", while the latter is known as "woven fabric".

In accordance with another optional characteristic of the invention, the inner face has a covered heat-welded seam construction (to prevent air leaks), adapted to create an uneven, three-dimensional shape when inflated.

According to another characteristic of the invention, the plurality of chambers and channels can extend up to the inner surface of the helmet corresponding to the cheek zone or even up to that which corresponds to the nape zone.

According to another aspect of the invention, a helmet characterised in that the inner surface of the helmet is formed from a protective liner such as that which is described above is also disclosed. The helmet can be a motorcycle helmet or other type of sports or professional helmet.

According to another aspect of the invention, the use of the previously described protective liner for reducing the rotational acceleration transferred to the liner user's head in case of accident is disclosed. The reduction in rotational acceleration is achieved by means of the air layer in the chambers created between the outer face of a rigid material and the inner face of an elastic liner material, as it has been demonstrated that the air disposed in the chambers thus formed is practically incapable of transferring tangential/shear stress. The protective liner object of the invention causes the helmet to which it is coupled to have an effect on the user as though the helmet were floating on the user's head. The join between the outer face and the inner face forms something similar to radial walls when the chambers of the protective liner are full of air, due to which they do not come into contact with the user's head. The only tangential resistance that could be generated by these joining walls would be that which is generated in the event that the user's head has previously been moved significantly with respect to the helmet, in a situation prior to the impact, wherein the walls would have an oblique orientation that would produce certain friction between the liner and the head, but if the protective liner placed inside the helmet is correctly inflated, the joining walls of the chambers would have a radial orientation that would make it possible to minimise the rotational accelerations suffered by the user in case of accident.

BRIEF DESCRIPTION OF THE DRAWINGS

The attached drawings illustrate, by way of non-limiting example, a preferred embodiment of the protective liner object of the invention. In said drawings.

DETAILED DESCRIPTION OF THE DRAWINGS

Figure 1:
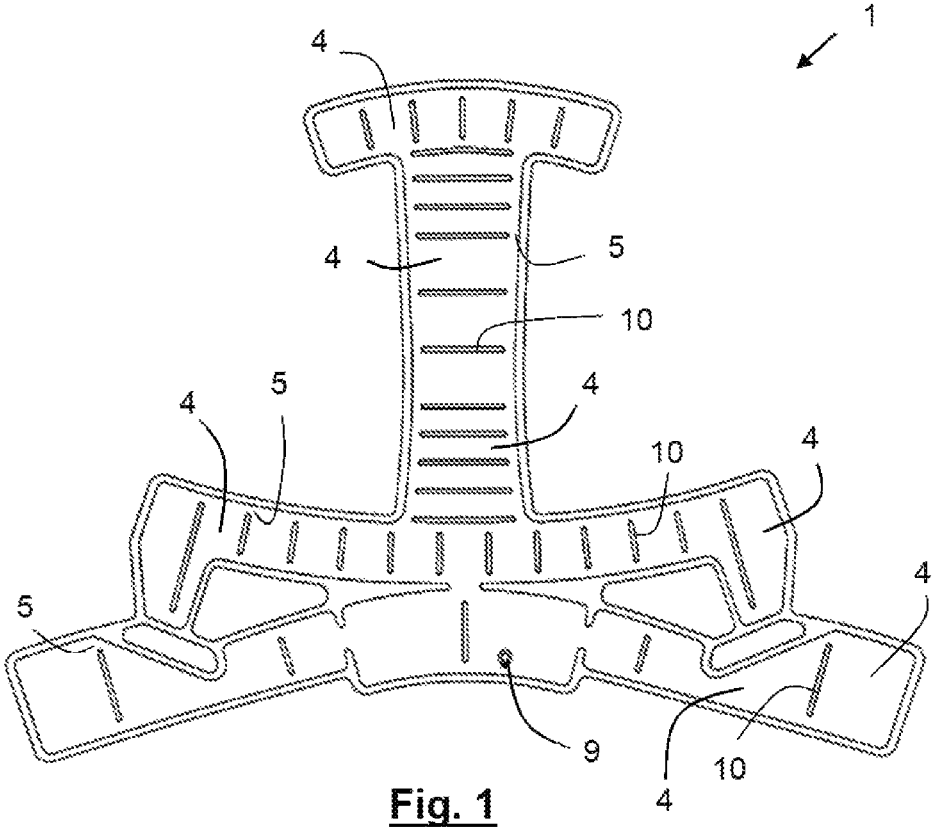
FIG. 1 shows a plan view of the protective liner object of the invention, seen from its inner face intended to come into contract with a user's head.

FIG. 1 shows, in an extended position, a protective liner 1 attachable to the inner surface of a helmet (not shown). The liner 1 is formed from a plurality of inflatable chambers 4 interconnected by channels 5 through which air is distributed, supplied for example by a pump through various valves, for example valve 9 of FIG. 1. In particular, it can be observed that, according to the liner 1 represented, the internal space of the liner 1 is divided by oblong partitions 10 whose ends are separated by a small distance from the perimeter contour of the liner 1 or from an internal contour that defines the contours of the chambers 4 themselves. This separation space is that which defines the passage of air from one chamber 4 to another, i.e. it is the space that forms the channels 5. The distance between two consecutive partitions 10 is designed to adapt to the specific shape of the head to be protected. Thus, the volume of the inflatable chambers 4 is variable according to the amount of air introduced. It is the user who, by controlling the inflation valve 9, regulates the amount of air until his or her head comes into contact with the inner face 2 of the liner 1 (the outer face 3 is the opposite face oriented towards the inner surface of the helmet). The user inflates the chambers 4 up to a level in which the pressurised air has occupied all the chambers 4 interconnected by the channels 5 at a homogeneous pressure, feeling a certain firmness from the chambers 4 on establishing contact with his or her head but without the liner 1 oppressing it excessively. The air is distributed through the chambers 4 depending on the space available between the head and the helmet at a homogeneous pressure in all the chambers, but with said pressure generating a variable chamber volume (or thickness) in accordance with the morphology of the head and the relative space in the zone of said chamber between the helmet and the head. In an operational protection position there should not be empty space allowing movement between the helmet and the head, i.e. the space must be occupied by the liner 1. If the user observes that the liner has been excessively inflated, he or she uses the valve 9 to deflate it to the appropriate degree in which the user feels comfortable but safe. It is proved for that the valve 9 may be disassembled from the helmet in order to wash it.

As can be observed in FIG. 1, the plurality of chambers 4 and channels 5 of the liner 1 form a single body that extends throughout the inner surface of the helmet at least above the Frankfurt plane or tragus-orbitale horizontal line. The Frankfurt plane is that which is formed by the imaginary line drawn from the lower end of the orbit (lower margin of the ocular orbit) to the upper edge of the external auditory canal (ear tragus or cartilage). The liner 1 may extend further than the Frankfurt plane and even reach the inner surface of the helmet corresponding to the cheek zone or even that corresponding to the nape zone. The protective liner 1 is placed coupled inside the helmet on the outer face 3. The liner 1 can be coupled to the helmet shell by means of appropriate fixing means (not shown) which may be provided in zones of its edges or in specific flat zones. For example, certain portions of the perimeter edge of the liner 1 may be joined to portions of fabric or strips having fixing means for joining the liner 1 to the inner surface of the helmet in a firm manner, removable (so as to enable disassembly) or even allowing a certain relative movement between the liner 1 and the impact-absorbing element.

Figure 2:
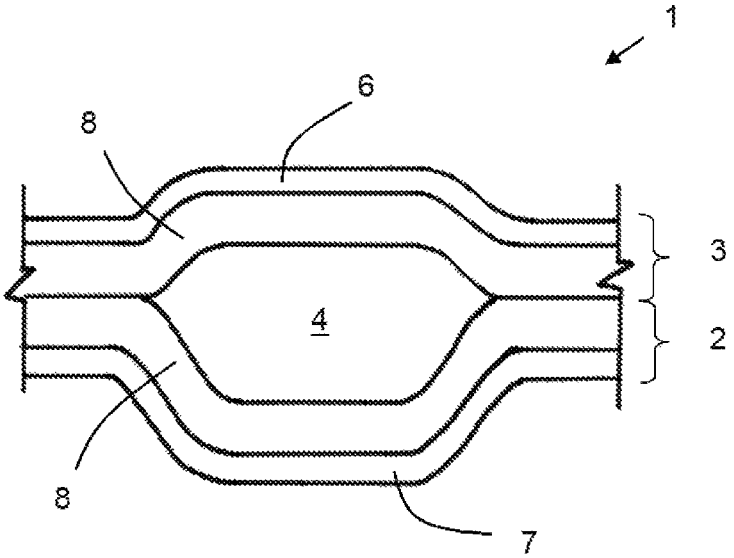
FIG. 2 shows a schematic sectional view of the layers of one of the chambers of the protective liner of FIG. 1.

In the cross-section shown in FIG. 2, it can be observed that the outer face 3 and the inner face 2 comprise respective layers of hydrophilic thermoplastic polyurethane layers 8 welded together in those sections that form the contours of the chambers 4 and channels 5, as a result of which the chambers 4 are permeable to water vapour, due to which the liner 1 is not uncomfortable or a source of heat and humidity due to being breathable. The helmet wherein the protective liner 1 is disposed may have its own aeration system through which the air in the interior of the helmet can communicate with the outside air. Another weldable material having equivalent properties with regards to its permeability to water vapour can be used instead of hydrophilic thermoplastic polyurethane.

The outer face 3 comprises, in addition to the hydrophilic thermoplastic polyurethane layer 8, a layer of rigid material 6, preferably a polyamide fabric having a linear weight comprised between 70 and 300 dtex.

Furthermore, the inner face 2 comprises, in addition to its respective layer of hydrophilic thermoplastic polyurethane 8, a layer of elastic material 7 whose area expands when the chambers 4 are filled with pressurised air, such that the expansion in volume of the liner 1 occurs mainly by means of the deformation of the layer of elastic material 7. Preferably, this layer of elastic material 7 has a linear elongation comprised between 20% and 150% with respect to its initial unloaded length and an elastic return greater than 95%. Possible elastic materials include mesh-type stretch fabrics ("knitted fabric" in English) and woven elastane-based fabrics ("woven fabrics" in English). Advantageously, the inner face 2 has a covered heat-welded seam construction adapted to create an uneven, three-dimensional shape when the liner 1 is inflated. The covered seam technique, also known as heat-welded seam, involves placing adhesive tape or welding tape over the seam, and offers a high degree of protection as it does not leave holes. FIG. 2 shows that the inner face 2 is that which separates more from the welding line between the hydrophilic thermoplastic polyurethane layers 8, i.e. that when the chambers 4 are inflated, most of the chamber volume is displaced towards the inner face 2, that which will come into contact with the head. This distribution of volume enables the liner 1 to adapt perfectly to different types of heads (round, flat, oval, egg or inverted egg-shaped heads, etc.), by inflating the liner 1 to a greater or lesser extent.

As shown in FIG. 2, the layer of rigid material 6 and the layer of elastic material 7 are colaminated respectively with the hydrophilic thermoplastic polyurethane layer 8 comprised by the outer face 3 and with the hydrophilic thermoplastic layer 8 comprised by the inner face 2.

The differential structural behaviour between the layer of rigid material 6 and the layer of elastic material 7 favours a unidirectional inflation of the chambers 4, such that when they are inflated they do not shrink laterally, due to which the inflated chambers 4 adopt and preserve the volumetric shape for which they were intended during the inflation process, mainly the shape conferred by the inner face 2, while simultaneously maintaining perfect cohesion between the outer face 3 of the liner 1 and the interior of the helmet.

This unidirectional inflation of the chambers contributes to reducing rotational acceleration, which is achieved by means of the air layer of the chambers 4 created between the outer face 3 of a rigid material and the inner face 2 of an elastic material of the liner 1, as it has been proven that the air disposed in the chambers 4 thus formed is practically incapable of transferring tangential/shear stress. The protective liner 1 causes the helmet to which it is coupled to have an effect on the user similar to that of floating on his or her head. The join between the outer face 3 and the inner face 2 forms something similar to radial walls when the chambers 4 of the protective liner 1 are full of air, due to which they do not come into contact with the user's head. As there is no contact, there is no friction between the liner 1 and the user's head, due to which, in case of accident, the rotational acceleration generated is not transferred to the user's head, protecting it from the brain injuries to which it would be exposed with a conventional liner.

Furthermore, it should be noted that the liner 1 allows comfortable adjustment to the user's head, being easy to introduce and remove the head from a helmet having the liner 1 in its interior. The configuration of the chambers 4 and of the channels 5 provides uniform pressure and good adaptability to different types of heads. The liner 1 is safe, long-lasting, washable, breathable and easy to use. In order to use the liner 1, the user must put on the helmet, adjust the retention system of the helmet and activate the inflation system formed, inter alia, by the inflating pump and the valve 9, which are both preferably disposed in the interior of the helmet and can be activated, for example, by means of a button easily accessible by the user, until he or she feels that a degree of pressure that affords optimum comfort has been reached. After performing the activity associated with the helmet, such as for example riding a motorcycle or participating in a competition or sporting activity, before removing the helmet the user has the option of activating the valve 9 button to partially deflate the liner 1 and then conveniently proceed to remove the helmet from his or her head.

Moreover, from the manufacturing point of view, a helmet having the liner 1 makes it possible to achieve a good quality-cost ratio, since the adaptability of the dimensions of the liner 1 once inflated enables the adaptation of a single helmet, with a certain shell, to users with different types of heads.

The invention claimed is:

1. A protective liner configured to be attached to an inner surface of a helmet, the protective liner comprises an inner face, configured to come into contact with a user's head and an outer face oriented towards the inner surface of the helmet when the protective liner is attached to the helmet and worn by the user, wherein a union of the inner face and the outer face forms a plurality of inflatable chambers interconnected by channels through which air is distributed, wherein the plurality of chambers and channels form a single body that is configured to extend along the inner surface of the helmet, including the inner surface on inner side portions of the helmet, wherein the chambers are permeable to water vapour and wherein the outer face comprises a layer of rigid material while the inner face comprises a layer of elastic material, wherein an area of the layer of elastic material increases when the chambers are filled with air, such that, upon inflation, expansion of the chambers in a radial direction when the protective liner is attached to the helmet of the protective liner occurs mainly through deformation of the elastic layer; and wherein the outer face and the inner face comprise respective layers of hydrophilic thermoplastic polyurethane welded together forming the chambers interconnected by channels.

2. The liner, according to claim 1, wherein the layer of rigid material and the layer of elastic material are colaminated respectively with the layer of hydrophilic thermoplastic polyurethane comprised by the outer face and with the layer of hydrophilic thermoplastic polyurethane comprised by the inner face.

3. The liner, according to claim 2, wherein the layer of rigid material is a polyamide fabric having a linear weight comprised between 70 and 300 dtex.

4. The liner, according to claim 2, wherein the layer of elastic material of the inner face has a linear elongation comprised between 20% and 150% with respect to an initial unloaded length of the layer of elastic material, and an elastic return greater than 95%.

5. The liner, according to claim 4, wherein the layer of elastic material of the inner face is a mesh-type stretch fabric or a woven elastane-based fabric.

6. A helmet for users of two-wheeled vehicles or for sports people wherein the inner surface of the helmet is formed by a protective liner according to claim 1.

7. A method of protecting a user's head, comprising wearing the liner according to claim 1 to reduce the rotational acceleration transferred to the liner user's head in case of accident.

8. A method of protecting a user's head, comprising wearing a helmet according to claim 6 to reduce the rotational acceleration transferred to the helmet user's head in case of accident.

9. A helmet for users of two-wheeled vehicles or for sports people wherein the inner surface of the helmet is formed by a protective liner according to claim 1.

10. A helmet for users of two-wheeled vehicles or for sports people wherein the inner surface of the helmet is formed by a protective liner according to claim 2.

* * * * *